US005771640A

United States Patent [19]

Back

[11] Patent Number: 5,771,640

[45] **Date of Patent: *Jun. 30, 1998**

[54] MODULAR SOLARIUM AND KIT FOR CONSTRUCTING THE SAME

[76] Inventor: Mark A. Back, 8833 W. Ridge Dr., Belvedire, Ill. 61008

[ * ] Notice: The term of this patent shall not extend beyond the expiration date of Pat. No. 5,560,151.

[21] Appl. No.: 717,487

[22] Filed: Sep. 20, 1996

Related U.S. Application Data

[63] Continuation-in-part of Ser. No. 257,736, Jun. 9, 1994, Pat. No. 5,560,155.

[51] Int. Cl.[6] ..... E04B 1/343

[52] U.S. Cl. ..... 52/90.1; 52/204.7; 52/277; 52/282.2; 52/762; 52/772; 52/DIG. 17

[58] Field of Search ..... 49/DIG. 2; 52/82, 52/90.1, 91.1, 93.1, 204.597, 204.7, 204.705, 235, 262, 277, 278, 282.2, 284, 309.16, 461, 469, 762, 772, 775, 780, 781.3, 783.1, 786.1, 786.11, 788.1, 800.1, 800.11, 800.14, DIG. 17

[56] References Cited

U.S. PATENT DOCUMENTS

| | | | |
|---|---|---|---|
| 2,947,040 | 8/1960 | Schultz . | |
| 3,055,461 | 9/1962 | DeRidder . | |
| 3,562,992 | 2/1971 | Kinsey . | |
| 3,733,756 | 5/1973 | Butler . | |
| 3,760,544 | 9/1973 | Hawes et al. . | |
| 3,805,470 | 4/1974 | Brown . | |
| 3,952,461 | 4/1976 | Kinsey . | |
| 3,978,629 | 9/1976 | Echols, Sr. | 52/235 |
| 4,040,219 | 8/1977 | Budich | 52/775 X |
| 4,057,941 | 11/1977 | Schwartz . | |
| 4,583,333 | 4/1986 | Minter . | |
| 4,601,139 | 7/1986 | Esposito . | |
| 4,724,646 | 2/1988 | Meyers | 52/93.1 X |
| 4,745,723 | 5/1988 | Esposito | 52/461 X |
| 4,765,102 | 8/1988 | Kuchem . | |
| 4,773,193 | 9/1988 | Biebuyck et al. | 52/93.1 |
| 4,796,395 | 1/1989 | Israel . | |
| 4,884,376 | 12/1989 | DeBlock et al. | 52/DIG. 17 X |
| 4,903,455 | 2/1990 | Veazey | 52/800.11 |
| 5,090,164 | 2/1992 | Mische . | |
| 5,125,207 | 6/1992 | Strobl, Jr. et al. . | |
| 5,325,647 | 7/1994 | Forry et al. . | |
| 5,363,615 | 11/1994 | Christopher et al. . | |
| 5,394,664 | 3/1995 | Nowell . | |
| 5,560,155 | 10/1996 | Back | 52/90.1 |

FOREIGN PATENT DOCUMENTS 2141165 12/1984 United Kingdom .

*Primary Examiner*—Carl D. Friedman
*Assistant Examiner*—Kevin D. Wilkens
*Attorney, Agent, or Firm*—Richard M. Goldberg

[57] ABSTRACT

A modular solarium includes (a) a plurality of prefabricated wall panels, each prefabricated wall panel including (i) at least one transparent sheet of material having a peripheral edge, and (ii) a peripheral frame of an L-shaped cross-section supporting the peripheral edge and positioned therearound, the peripheral frame having opposite exposed surfaces with an opening in at least one of the exposed surfaces; (b) a plurality of prefabricated ceiling panels, each prefabricated ceiling panel including (i) at least one transparent sheet of material having a peripheral edge, (ii) a peripheral frame of an L-shaped cross-section supporting the peripheral edge and positioned therearound, the peripheral frame having opposite exposed surfaces with an opening in at least one of the exposed surfaces; and (c) a plurality of joint members for connecting together the prefabricated panels, each joint member including (i) a joint frame member, and (ii) at least two protrusions extending from the joint frame member, each protrusion having a free enlarged end such that one protrusion lockingly engages within a respective opening of a first one of the panels and another protrusion lockingly engages within a respective opening of a second one of the panels, wherein the first and second panels are locked to each other by the joint members to form the modular solarium.

39 Claims, 11 Drawing Sheets

MODULAR SOLARIUM AND KIT FOR CONSTRUCTING THE SAME

REFERENCE TO RELATED APPLICATION

The present application is a continuation-in-part of U.S. patent application No. 08/257,736, filed Jun. 9, 1994 in the name of Mark A. Back, and entitled Modular Solarium, issued as U.S. Pat. No. 5,560,155 on Oct. 1, 1996.

BACKGROUND OF THE INVENTION

The present invention relates generally to solariums, and more particularly, is directed to a modular solarium formed of preassembled panels.

In consideration of new housing prices, many households are constructing additions or otherwise remodeling their existing homes to add features which were unavailable or unaffordable at purchase, rather than purchasing newer homes. One feature which has become increasingly popular is the solarium or sunroom, an extension formed primarily of transparent panels for walls and ceiling.

In many cases, the owner of the home or property prefers to perform the work himself, rather than incurring the expense of hiring a professional to do the work. While this may be feasible in the case of standard construction, specialized work such as glazing large panels for a solarium is generally beyond the average handyman. Thus, when labor costs are added to the cost of the materials, quite often such a solarium addition or the like is beyond the budget of the home or property owner.

Further, because of the great amount of labor involved, the construction of such a conventional solarium takes a relatively long time, for example, a few days or more even by skilled professionals.

SUMMARY OF THE INVENTION

Accordingly, it is an object of the present invention to provide a modular solarium and kit for constructing the same that avoids the aforementioned problems.

It is another object of the present invention to provide a modular solarium which makes use of prefabricated glazed panels comprising a transparent sheet material, surrounded by a peripheral frame, along with joint members which connect adjacent panels together.

It is still another object of the present invention to provide a modular solarium which requires no tools or separate fasteners for assembly, but includes cooperating fastening components formed in the frames and joint members, for ease of assembly by means of an interlocking construction.

It is yet another object of the present invention to provide a modular solarium having interiorly concealed structural steel reinforcement in at least the ceiling portions of the joint members.

It is a further object of the present invention to provide a modular solarium in which the peripheral frame members include internal passages for the reduction of weight and for the passage of electrical, plumbing, and/or other elements therethrough.

It is a still further object of the present invention to provide a modular solarium which includes insulation between adjacent frame members.

It is a yet further object of the present invention to provide a modular solarium which includes unbroken expanses of transparent material between the peripheral frame members, with lateral muntins installed beneath the transparent sheets in at least the ceiling or roof panels.

It is another object of the present invention to provide a modular solarium which meets all of the different building codes in the United States.

It is another object of the present invention to provide a modular solarium which is inexpensive and easy to manufacture and assemble.

In accordance with an aspect of the present invention, a modular solarium includes (a) a plurality of prefabricated wall panels, each prefabricated wall panel including (i) at least one transparent sheet of material having a peripheral edge, and (ii) a peripheral frame supporting the peripheral edge and positioned therearound, the peripheral frame having opposite exposed surfaces with an opening in at least one of the exposed surfaces; (b) a plurality of prefabricated ceiling panels, each prefabricated ceiling panel including (i) at least one transparent sheet of material having a peripheral edge, (ii) a peripheral frame supporting the peripheral edge and positioned therearound, the peripheral frame having opposite exposed surfaces with an opening in at least one of the exposed surfaces; and (c) a plurality of joint members for connecting together the prefabricated panels, each joint member including (i) a joint frame member, and (ii) at least two protrusions extending from the joint frame member, each protrusion having a free enlarged end such that one protrusion lockingly engages within a respective opening of a first one of the panels and another protrusion lockingly engages within a respective opening of a second one of the panels, wherein the first and second panels are locked to each other by the joint members to form the modular solarium.

Each prefabricated panel includes at least one retainer for retaining the a transparent sheet of material in the respective peripheral frame. In this regard, each peripheral frame includes at least one retainer opening for receiving at least one retainer such that the at least one retainer clamps a respective transparent sheet of material against the respective peripheral frame. Each retainer preferably has a generally triangular cross-sectional configuration having at least one extension at an apex thereof, with the at least one extension fitting within the at least one retainer opening to secure the retainer to the respective peripheral frame.

Each peripheral frame has an L-shaped cross-sectional configuration comprising a first leg and a second leg at right angles to the first leg, the second leg defining a seat on which the transparent panel is positioned, and the first leg having the at least one retainer opening therein for receiving the at least one retainer such that the at least one retainer clamps the respective transparent sheet of material against the second leg.

At least one joint frame member has a generally U-shaped configuration, and includes two sets of protrusions, the sets being arranged in spaced apart, substantially parallel relation and interconnected by the joint frame member. Specifically, at least one joint frame member includes a central frame member, and two flanges extending away from each other at opposite sides of the central frame member, with the protrusions being formed on the flanges. The central frame member has a U-shaped configuration which is positioned between adjacent panels to be connected together, the central frame member having opposite free ends, and the flanges extend from the opposite free ends of the U-shaped central frame member. Thus, the central frame member includes two spaced apart walls which define a channel therebetween, and at least one joint member includes a longitudinal reinforcement member captured within the channel.

In this regard, the ceiling reinforcing members are positioned between adjacent ceiling panels and wall reinforcing members are positioned between adjacent wall panels, and the ceiling reinforcing members are supported by the wall reinforcing members so as to support the ceiling panels on the wall panels.

In connecting the panels together, a first joint frame member has a plurality of the protrusions which engage within at least one opening in an outer surface of each of peripheral frames of adjacent prefabricated panels, and a second joint frame member has a plurality of protrusions which engage within at least one opening in an opposite inner surface of each of peripheral frames of the adjacent prefabricated panels.

In addition, an insulation member is surrounded by the first and second joint frame members and the adjacent peripheral frames.

At least one joint member further includes a cap which is secured to and covers the joint frame member thereof.

Further, each of the peripheral frames includes a plurality of passages therein.

In another embodiment, the solarium includes a corner between a front wall and a side wall thereof, two adjacent wall panels meet at the corner and are offset from each other so as to define a corner space, and at least one of the joint members is a corner joint member having a joint frame member positioned in the corner space and at least two protrusions of each corner joint member extend from opposite corners of the joint frame member such that at least one protrusion lockingly engages within a respective opening of a first one of the adjacent wall panels and at least another protrusion lockingly engages within a respective opening of a second one of the adjacent panels, wherein the first and second adjacent panels at the corner are locked to each other by the corner joint member. In such case, the protrusions of the joint frame member of the corner joint member preferably lockingly engage within respective openings in outer walls of the adjacent panels.

In addition, the joint frame member of the corner joint member may include a third corner positioned at a junction of the first and second adjacent panels, with at least two further protrusions extending from the joint frame member at the third corner, each further protrusion having a free enlarged end such that one further protrusion lockingly engages within a respective opening in an inner wall of the first one of the panels and another protrusion lockingly engages within a respective opening in an inner wall of the second one of the panels, wherein the first and second panels are further locked to each other by the corner joint member.

Preferably, the ceiling panels are inclined upwardly and rearwardly from the wall panels of a front wall of the modular solarium. In such case, at least one protrusion of the joint frame member lockingly engages within a respective opening in an outer wall of one ceiling panel and at least another protrusion lockingly engages within a respective opening in an outer wall of an adjacent the wall panel, wherein the ceiling and wall panels are locked to each other by the joint member. In order to retain the inclination of the roof, a wedge joint member is mounted at an upper surface of the wall panel adjacent an inner surface thereof, for supporting the adjacent ceiling panel thereon at an inclination.

Preferably, the wedge joint member includes a substantially trapezoidal joint frame member having at least one protrusion with a free enlarged end such that the at least one protrusion lockingly engages within a respective opening in the inner surface of at least one of the ceiling panel and adjacent wall panel.

In such case, a wall securing member is secured to a wall of a building and includes at least one protrusion having a free enlarged end for lockingly engaging within a respective opening at a rear portion of each ceiling panel.

In accordance with another aspect of the present invention, a kit for forming a modular solarium construction, includes (a) a plurality of prefabricated wall panels, each prefabricated wall panel including (i) at least one transparent sheet of material having a peripheral edge, (ii) a peripheral frame supporting the peripheral edge and positioned therearound, the peripheral frame having opposite exposed surfaces with an opening in at least one of the exposed surfaces; (b) a plurality of prefabricated ceiling panels, each prefabricated ceiling panel including (i) at least one transparent sheet of material having a peripheral edge, (ii) a peripheral frame supporting the peripheral edge and positioned therearound, the peripheral frame having opposite exposed surfaces with an opening in at least one of the exposed surfaces; and (c) a plurality of joint members for connecting together the prefabricated panels, each joint member including (i) a joint frame member, and (ii) at least two protrusions extending from the joint frame member, each protrusion having a free enlarged end such that one protrusion is adapted to lockingly engage within a respective opening of a first one of the panels and another protrusion is adapted to lockingly engage within a respective opening of a second one of the panels, wherein the first and second panels are adapted to be locked to each other by the joint members to form the modular solarium.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
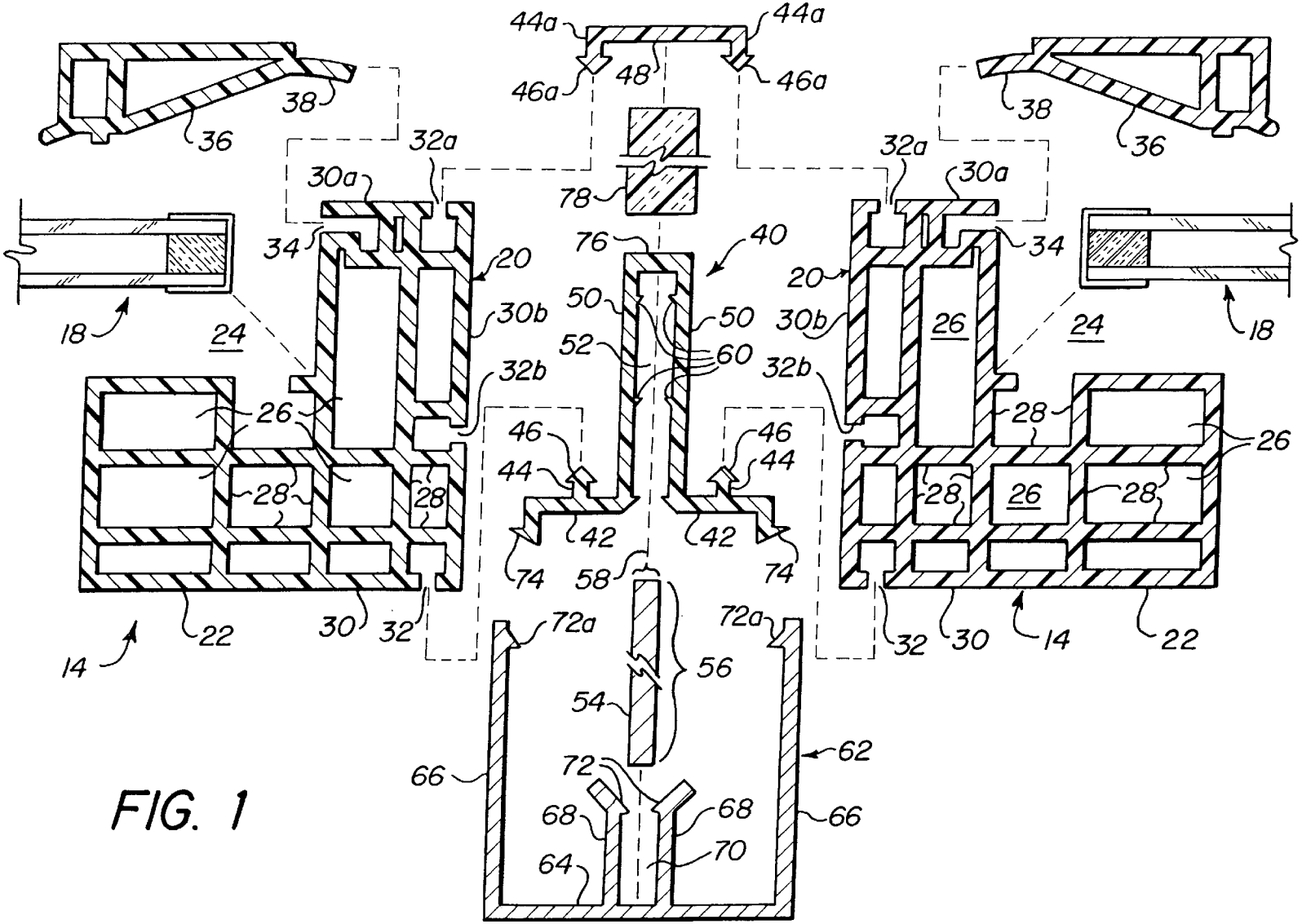
FIG. 1 is an exploded view, in section, of the components of the present invention, showing details of the peripheral frame and joint members and their mutual securing means.
Figure 2:
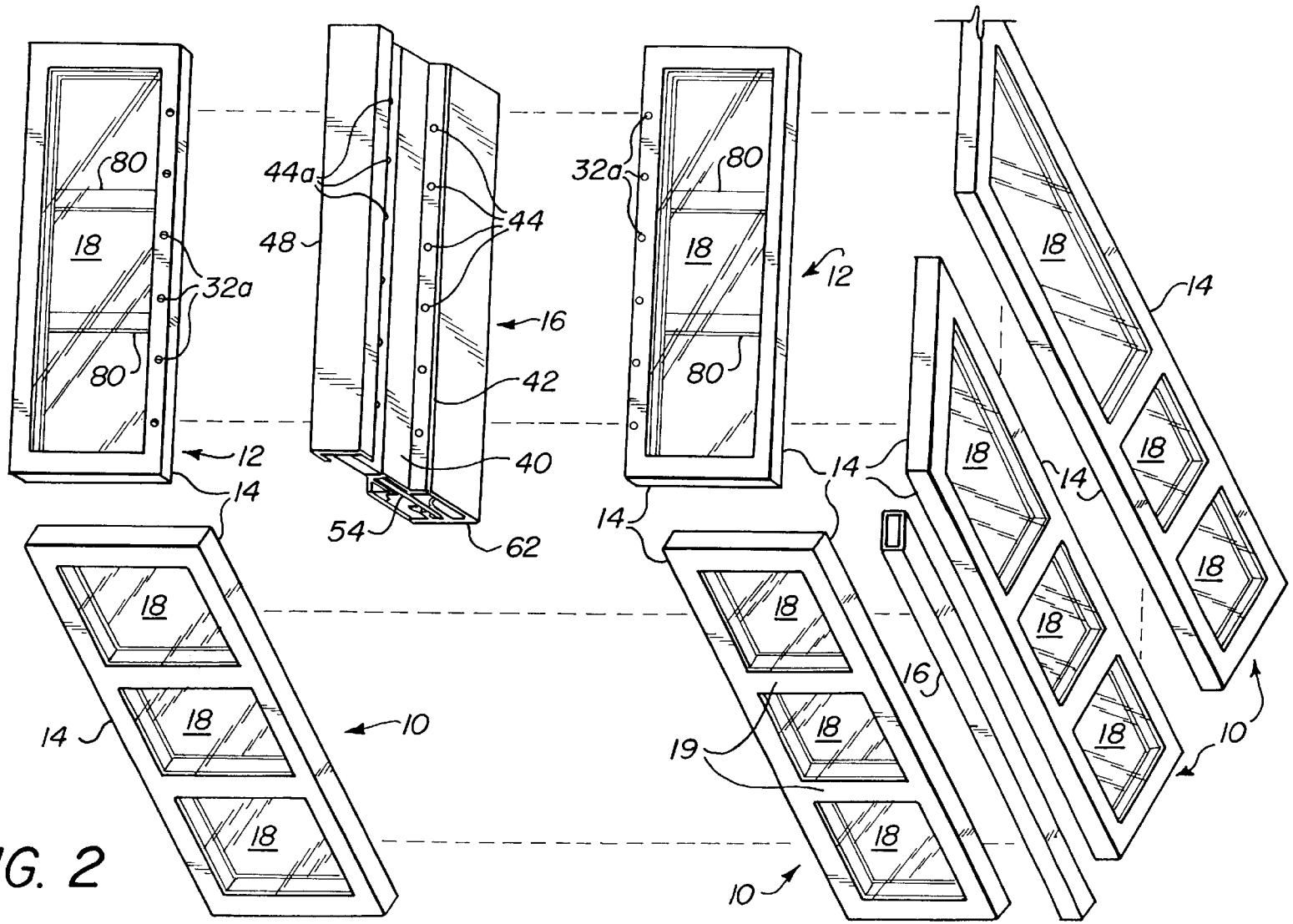
FIG. 2 is an exploded perspective view of an assembly of panels of the present invention, showing their relative positions for assembly.
Figure 3:
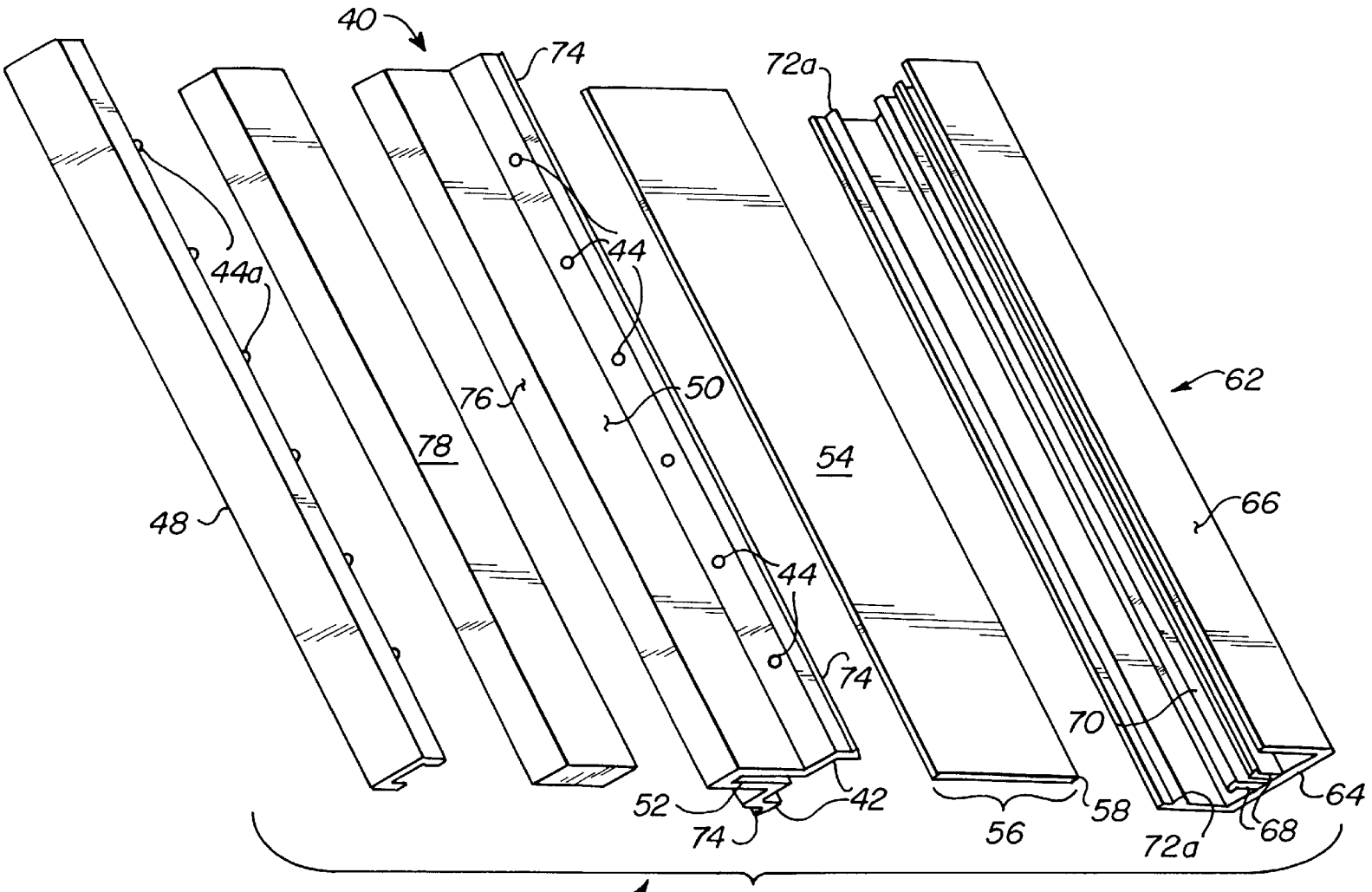
FIG. 3 is an exploded perspective view of one of the joint members, showing the order of assembly thereof.

Referring to the drawings, and initially to FIGS. 1–3, a modular solarium according to the present invention includes a plurality of prefabricated rectangular wall panels 10 and prefabricated rectangular roof or ceiling panels 12 to be assembled together at an installation site. Each prefabricated panel 10 and 12 includes a peripheral rectangular frame 14 and at least one transparent sheet 18 of material supported at its peripheral edges by the respective frame 14. Although wall panels 10 are shown as having three transparent sheets 18, this number can vary. In the case of the three sheets of wall panels 10, they are further supported by and separated from each other by transverse muntins 19. Further, while wall panels 10 are shown as having plural transparent sheets 18 therein, separated by muntins 19, it will be understood that each transparent sheet 18 of wall panels 10 may include its own peripheral frame 14, and may be assembled to other wall panels 10 using joint members, in the manner to be described further below. Each panel 18 is preferably made from glass due to its weather resistance, durability, and resistance to discoloring as a result of the effects of ultraviolet and other sunlight. However, any other suitable transparent sheet material, such as plastic, can be used. Preferably, double (or even triple) pane sheet panels 18 are used, for optimum thermal efficiency.

Since panels 10 and 12 are prefabricated with glass 18 and frame 14 already assembled together, various standard dimension panels can be stocked, thereby making construction of the solarium less expensive.

First joint members 16 are provided for connecting together panels 10 and 12. Each joint member 16 includes first cooperating means for interlocking installation with second cooperating means formed in frames 14 of panels 10 and 12. Since panels 10 and 12 are prefabricated, the solarium can be assembled in the field, merely by the interlocking assembly of the second cooperating means of panels 10 and 12 with the first cooperating means of joint members 16. The corner joint member 16 in FIG. 2 is not shown in complete detail for brevity of illustration.

FIG. 1 discloses an exploded detailed view of two frames 14 to be connected together by a first joint member 16.

Frames 14 and joint members 16 are preferably formed of a plastic material for corrosion resistance, light weight, ease of extrusion, and other desirable properties. In this regard, ultra high density polyvinyl chloride (UPVC) plastic material has been found to be satisfactory for the construction of frames 14 and joint members 16 of the present invention. The use of plastic, for example, UPVC material, provides for a lightweight yet sturdy frame and joint structure which is highly resistant to weathering and is impervious to corrosion.

Frames 14 are preferably extruded or otherwise formed in the general shape of an "L," with a first leg 20 and a second leg 22 at right angles to first leg 20. The resulting space 24 between the two legs 20 and 22 provides a seat for a transparent panel 18. Preferably, frames 14 are not formed as a solid section, but are formed with a plurality of longitudinal passages 26 therein, with internal webs 28 defining and separating passages 26. Such construction provides exceptional strength, while still providing relatively light weight. Further, such internal passages 26 provide for the passage of electrical, plumbing, and/or other elements therethrough. The outer/upper wall 30*a* at the free end of each frame member 14 includes an elongated passage or a series of holes or passages 32*a* formed therein, while the inner/lower wall 30 which is opposite to outer/upper wall 30*a* includes an elongated passage or a series of holes or passages 32 formed therein. Passages 32 and 32*a* provide for the field assembly of joint members 16 with frames 14 to form a solarium of modular construction.

Frames 14 further include a slot 34 adjacent the free end of first leg 20 and which is positioned to face toward space 24. Slot 34 cooperates with a peripheral transparent sheet retainer 36 to permanently secure a transparent sheet 18 within seat 24 of frame 14. Each retainer 36 is of generally triangular cross section, with an extension 38 formed along one apex thereof. Extension 38 is formed with a concave curvature along its inner side, which when inserted into slot 34, causes the retainer 36 to be biased against transparent sheet 18 to sandwich transparent sheet 18 between the second leg 22 of frame member 14 and retainer 36.

Transparent sheet 18, along with retainer 36, is preferably installed within frame section 14 using a relatively weatherproof and moistureproof sealant. A silicone sealant has been found to work well for such an application. Transparent sheets 18 are permanently assembled within frames 14, with retainers 36 being permanently installed thereover, at the time of manufacture of the panels 10 and 12, to form panels 10 and 12 as preassembled panels.

Referring to FIGS. 1 and 3, joint member 16 includes a central U-shaped frame connecting member 40 which includes two parallel, spaced apart walls 50 defining a channel 52 therebetween, with walls 50 being connected together at one end thereof by a top wall 76. Two flanges 42 extend outwardly from the free ends of walls 50, with flanges 42 including a plurality of protrusions 44 having free enlarged ends or arrow head tips 46 thereon. Tips 46 of protrusions 44 are larger than holes or passages 32 and 32*a* in walls 30 and 30*a* of frame members 14. However, due to the resilient nature of the plastic materials of which frame members 14 and joint members 16 are made, tips 46 may be distorted sufficiently to pass through holes or passages 32 and 32*a* and be captured within internal frame passages 26, thereby providing a rapid and easy permanent assembly of frames 14 (and their included transparent panels 18) with central connecting members 40 of joint members 16.

Flanges 42 and their protrusions 44 connect the lower walls 30 of peripheral frames 14 of ceiling panels 12 and inner walls 30 of peripheral frames 14 of wall panels 10. Specifically, one tip 46 of a frame connecting member 40 passes through holes or passages 32 of one panel 10 or 12, and the other tip 46 of the same frame connecting member 40 passes through holes or passages 32 of another adjacent panel 10 or 12, so as to connect the panels together. Thus, two adjacent wall panels 10 can be connected together; two adjacent ceiling panels 12 can be connected together, or a wall panel 10 can be connected to a ceiling panel 12.

Figure 4:
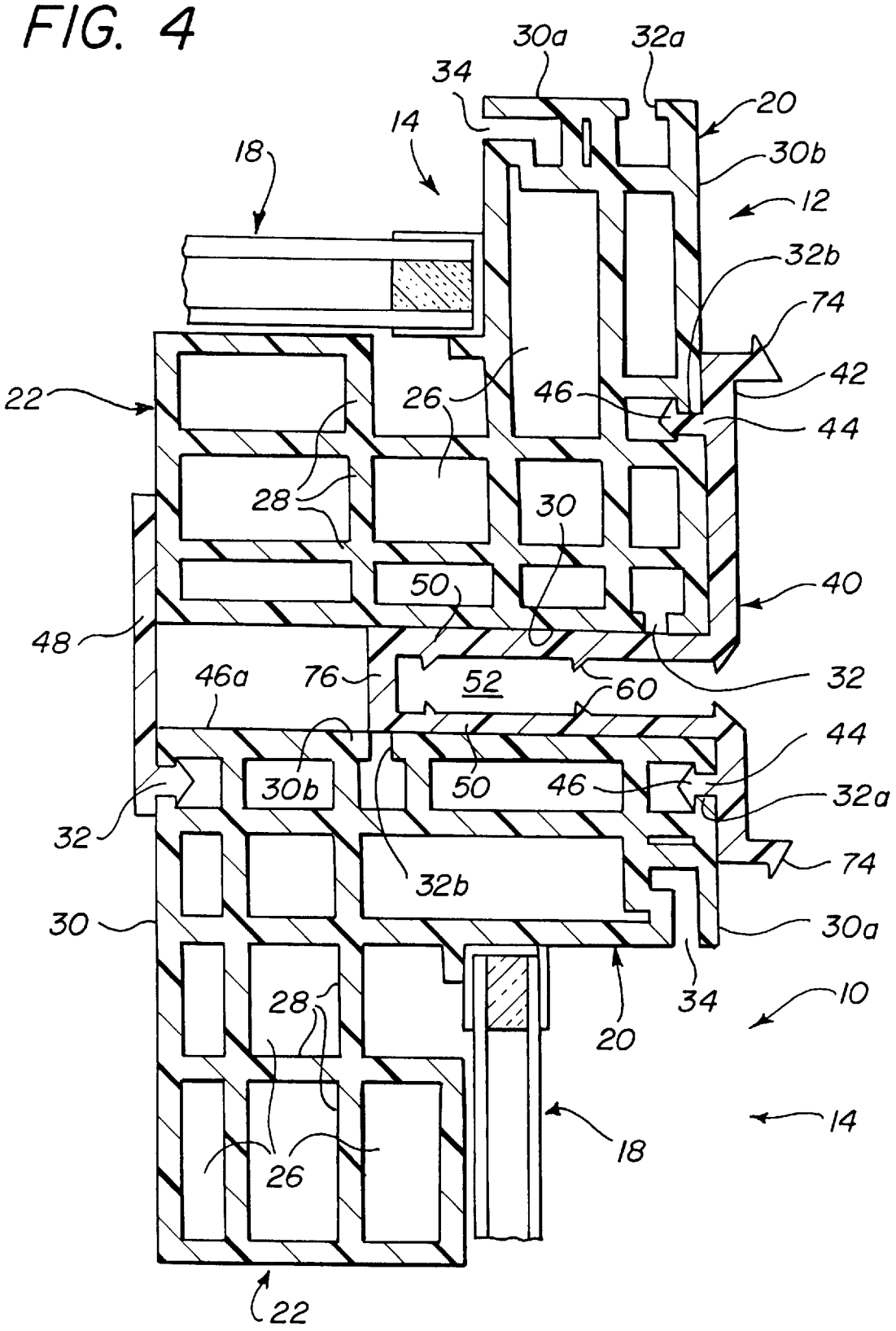
FIG. 4 is a cross-sectional view of an assembled corner of the solarium according to the present invention.

As shown in FIG. 1, on the wall 30*b* of leg 20 of frame 14 which connects walls 30 and 30*a*, an elongated passage or a series of holes or passages 32*b* are formed therein. Thus, at the corners of the solarium where two wall panels 10 are arranged at right angles to each other, the wall 30*b* of one frame 14 will be in alignment or formed as a co-extension of the wall 30*a* of another frame, as shown in FIG. 4. In such case, one tip 46 of a frame connecting member 40 passes through holes or passages 32*a* of one panel 10, and the other tip 46 of the same frame connecting member 40 passes through holes or passages 32*b* of another adjacent panel 10, so as to connect the panels together. Of course, in such case, the dimensions of frame connecting member 40 would change, as shown in FIG. 4. The assembly of FIG. 4 can also be used to connect a wall panel 10 to an adjacent ceiling panel 12 in the case where there is no inclination of the ceiling panels 12.

The above discussed field assembly will result in a structure which is adequately sturdy under most conditions.

However, in the event that additional strength and/or stiffness is required, for example, for panel spans of several feet or more, additional strength may be provided. In this regard, channel 52 provides room for the installation of a longitudinally reinforcing steel plate 54, or other suitable component, therein. Plate 54 has a width 56 considerably greater than its thickness 58, which width 56 may extend somewhat beyond the depth of channel 52 of central connecting member 40. The thickness 58 closely cooperates with the width of channel 52, and is retained therein by a plurality of inwardly facing teeth 60 on the inner surfaces of walls 50, which grip the outer surfaces of plate 54. By orienting plate 54 so that its width 56 is oriented perpendicularly to the plane of panels 10 and 12, considerably greater bending strength for the panels is provided.

As the above described plate 54 may extend somewhat beyond the mouth of the central connector channel 52, a metal internal cover 62 may be provided to conceal the inner edge of plate 54. Cover 62 is formed as a U-shaped member including parallel, spaced apart walls 66 connected at ends thereof by a connecting member 64. Two spaced apart flanges 68 extend from connecting wall 64, inwardly spaced from walls 66, with flanges 68 defining a channel 70 and including inwardly gripping ribs 72 for the securement of cover 62 to opposite surfaces of plate 54. Additional inwardly gripping ribs 72*a* are provided on the inner surfaces at the free ends of walls 66, which ribs 72*a* cooperate with outwardly gripping latches 74 extending from flanges 42. Thus, when adjacent panels 10 and/or 12 have been connected by means of joint members 16, and a plate 54 installed within channel 52 of the frame connecting member 40, cover 62 may be locked into place by means of interlocking ribs 72*a* and latches 74, as well as by inwardly gripping ribs 72 which engage opposite sides of plate 54.

A further connecting means may be provided between outer/upper walls 30*a* of frame members 14 by a second, outer connecting joint member 48 which spans two adjacent frame members 14 of adjacent panels 10, 10; 10, 12; or 12, 12. Second joint member 48 includes a series of protrusions 44*a* at opposite ends thereof, with each protrusion 44*a* including a free enlarged end or arrow head tip 46*a* extending therefrom, in the same manner as protrusions 44 and arrow head tips 46 of central frame connecting member 40 discussed above. Protrusions 44*a* with their arrow head tips 46*a* interlock with holes or passages 32*a* in outer/upper wall 30*a* of frame members 14 to further provide for the assembly of panels 10 and 12. Alternatively, second joint member 48 can merely be provided for a decorative effect, without providing structural support therefor, as shown, for example in FIG. 4. In such case, frame connecting members 40 would provide the sole connection.

While preferably double sheet transparent panels 18 and air spaces provided by internal passages 26 within frame members 14 each provide insulating advantages and thermal efficiency for the present construction, it will be noted that steel reinforcing plate 54 and metal internal cover 62 are highly thermally conductive and provide a thermal path from the interior of the solarium structure to the airspace adjacent exterior joint member 48. Accordingly, some space is provided between the interior of joint member 48 and top wall 76 of frame connecting member 40, for the installation of insulation 78 therein. The insulation 78 may be of any suitable type, for example, a synthetic foam mastic or other suitable material.

The above described modular construction will be seen to provide a quickly and easily built solarium or other structure for additions to present structures or other uses. The prefabricated assembly of transparent panels 18 with peripheral frame members 14 and peripheral transparent sheet retainers 36 during manufacture, provides for quick and easy assembly of wall and ceiling panels 10 and 12 in the field by means of joint members 16. Panels 10 and 12 may be manufactured in virtually any size and shape and no special tools or equipment are needed, as joint members 16 automatically interlock with frame components 14 to provide a sturdy, completed structure. Further structural strength is provided by steel plates 54 installable within the joint members 16.

Additional transverse strength for elongate panels, for example, ceiling panels 12 which include a single transparent sheet 18 of material, may be provided by transverse muntins 80 installed on the inner sides of frames 14, as shown in FIG. 2, to provide an unbroken expanse of glass or other transparent sheet between peripheral frame members 14. Accordingly, there are no externally exposed muntins or other structural members, thereby precluding the trapping of moisture and debris in such areas.

Figure 5:
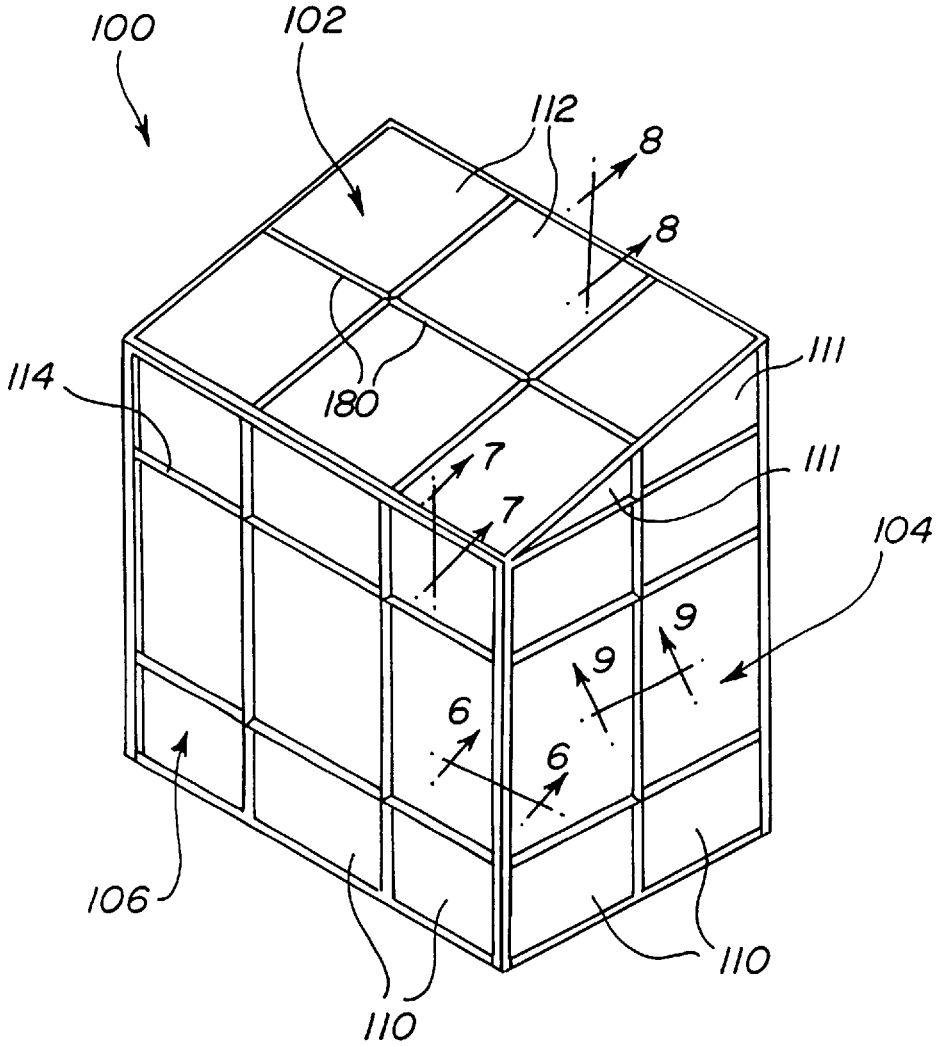
FIG. 5 is a perspective view of a solarium constructed according to another embodiment of the present invention.

Referring now to FIG. 5, there is shown a solarium 100 constructed according to another embodiment of the present invention, with a slanted roof 102 formed from roof or ceiling panels 112, and parallel and spaced apart side walls 104 and a front wall 106, formed from wall panels 110. Solarium 100 is constructed with frame members 114 which are substantially identical to frame members 14, but with slightly different dimensions. Accordingly, the elements of frame members 114 that correspond to those of frame members 14 in the following FIGS. 6–10 are identified by the same reference numerals, augmented by 100, so that a detailed description of the common elements is not provided. It will further be appreciated that frame members 114 of FIGS. 6–10 are not drawn to scale, and accordingly, the dimensions and thicknesses of the walls may vary within the scope of the present invention.

Figure 6:
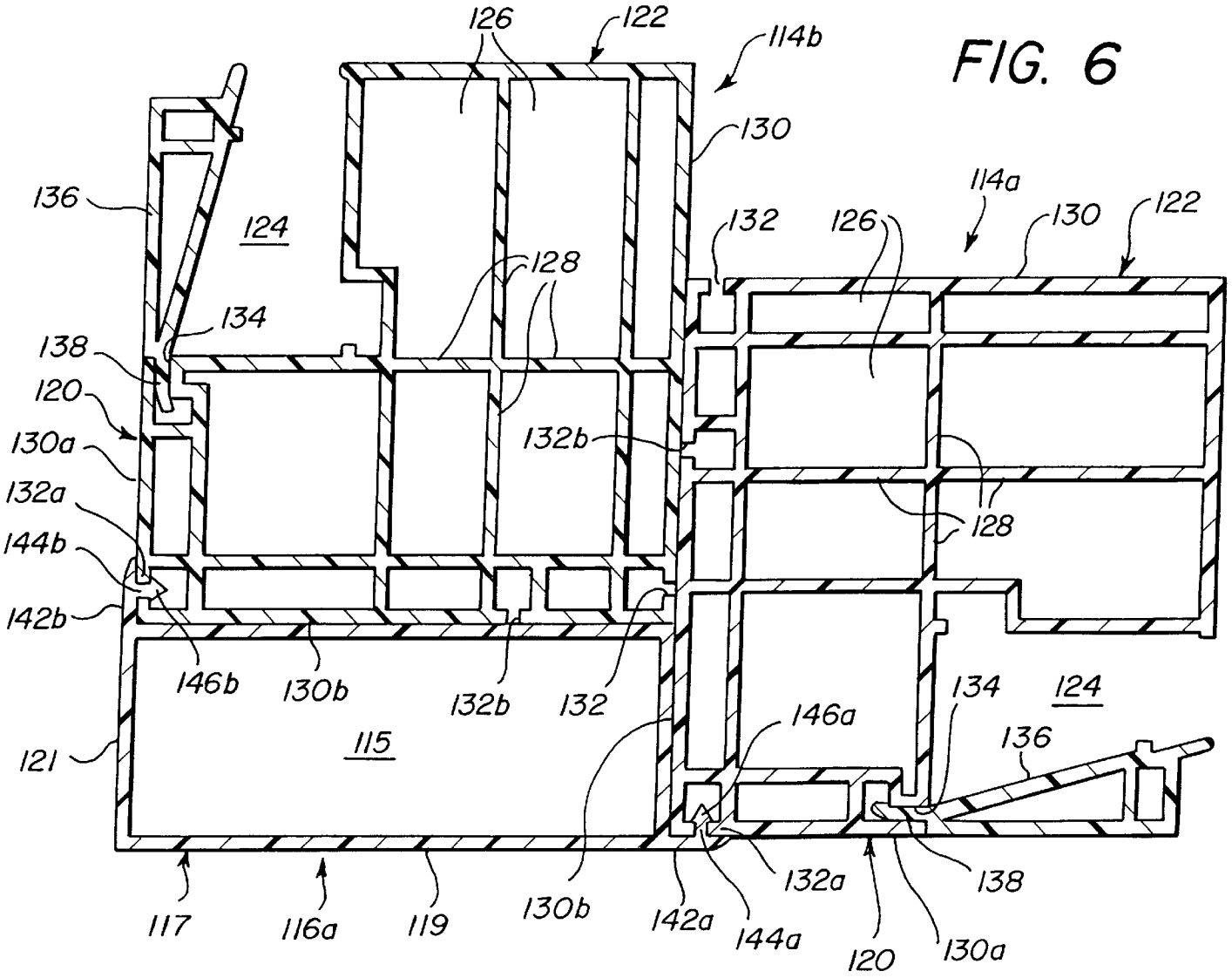
FIG. 6 is a cross-sectional view of the solarium of FIG. 5, taken along line 5—5 thereof.

FIG. 6 is a cross-section of FIG. 5, taken along line 6—6 thereof, and which shows a corner connection of one side wall 104 and front wall 106. As shown therein, wall 130*b* of one frame member 114*a* is abutted against a wall 130 of another frame member 114*b* situated at right angles thereto. In this case, holes or passages 132*b* of frame member 114*a* are closed by wall 130 of frame member 114*b*, while holes or passages 132 of frame member 114*b* are closed by wall 130*b* of frame member 114*a*. However, the two frame members 114*a* and 114*b* are offset from each other to provide a substantially rectangular corner space 115 for receiving a modified elongated joint member 116*a*.

Specifically, modified joint member 116*a* includes, in cross-section, a rectangular body 117. One longer side 119 of rectangular body 117 includes an extension flange 142*a* having one elongated protrusion or a plurality of protrusions 144*a* having free enlarged ends or arrow head tips 146*a* thereon. One shorter side 121 of rectangular body 117 includes an extension flange 142*b* having one elongated protrusion or a plurality of protrusions 144*b* having free enlarged ends or arrow head tips 146*b* thereon. Protrusions 144*b* are provided on the corner of rectangular body 117 that is opposite to protrusions 144*a*.

Thus, rectangular body 117 fits in corner space 115 such that tips 146*a* fit within holes or passages 132*a* of frame member 114*a* and tips 146*b* fit within holes or passages 132*a* of frame member 114*a* to connect frame members 114*a* and 114*b* together. In this case, an inner connecting member is not used.

Figure 6A:
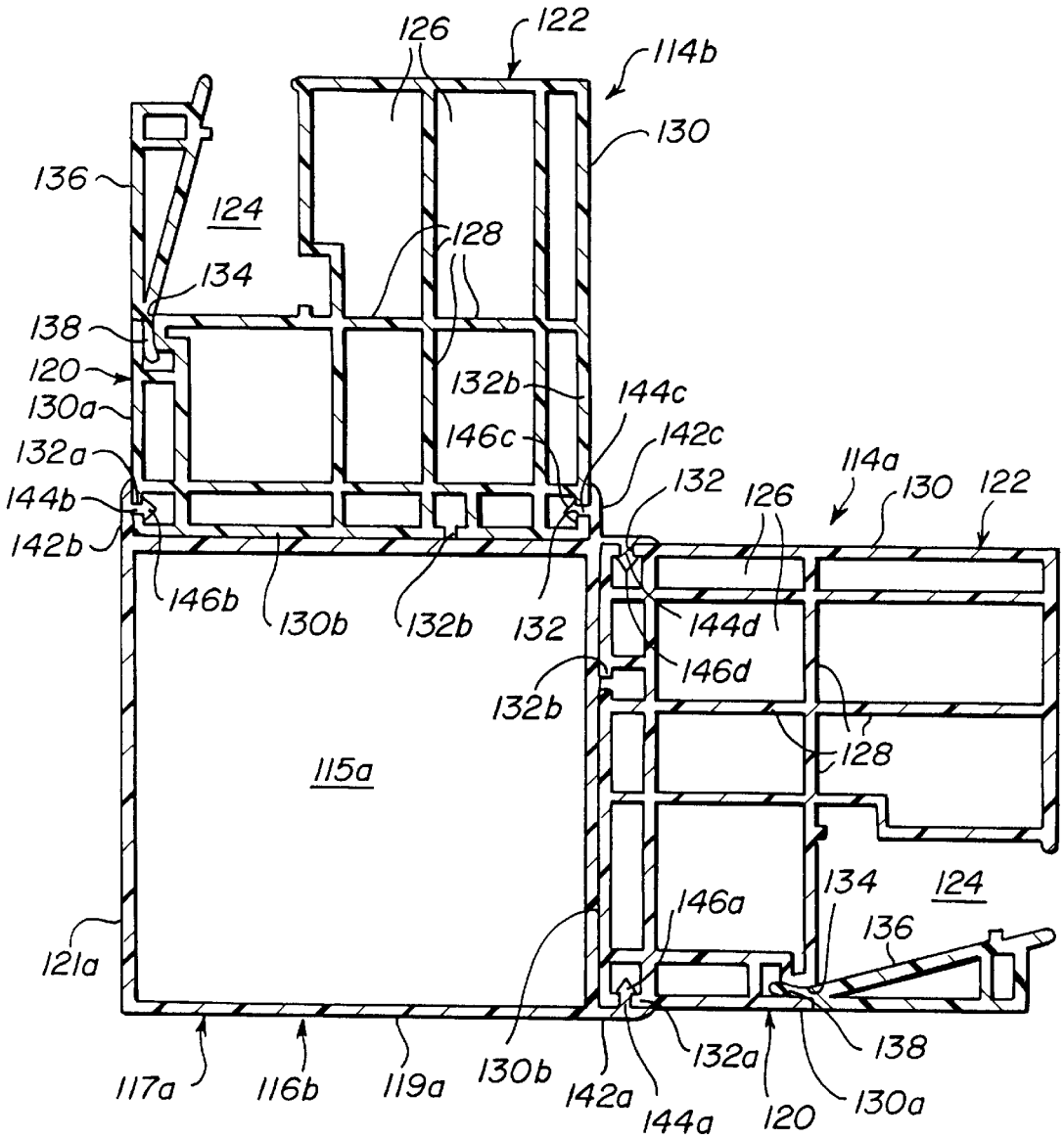
FIG. 6A is a cross-sectional view similar to FIG. 6, showing a modification thereof.

FIG. 6A is a cross-sectional view similar to FIG. 6, showing a modification thereof. Specifically, the corners of frame member 114*a* and 114*b* are situated close to each other, such that there are no abutting walls. Thus, corner space 115*a* for receiving a modified elongated joint member 116*b* is made larger than corner space 115 of FIG. 6.

Specifically, modified joint member 116*b* includes, in cross-section, a square body 117*a*. One side 119*a* of square body 117*a* includes an extension flange 142*a* having one elongated protrusion or a plurality of protrusions 144*a* having free enlarged ends or arrow head tips 146*a* thereon. An adjacent side 121*a* of square body 117*a* includes an extension flange 142*b* having one elongated protrusion or a plurality of protrusions 144*b* having free enlarged ends or arrow head tips 146*b* thereon. Protrusions 144*b* are provided on the corner of square body 117*a* that is opposite to protrusions 144*a*.

In addition, at an inner corner of square body 117*a*, an L-shaped extension flange 142*c* is provided with a first leg thereof having one elongated protrusion or a plurality of protrusions 144*c* having free enlarged ends or arrow head tips 146*c* thereon, and a second leg thereof having one elongated protrusion or a plurality of protrusions 144*d* having free enlarged ends or arrow head tips 146*d* thereon.

When square body 117*a* is fit in corner space 115*a*, tips 146*c* fit within holes or passages 132 of frame member 114*a*and tips 146*d* fit within holes or passages 132 of frame member 114*b* to connect frame members 114*a* and 114*b* together.

Of course, it will be appreciated that, in FIGS. 6 and 6A, the body 117 or 117*a* can be made of any other suitable shape, such as of a triangular cross-section or the like.

Figure 7:
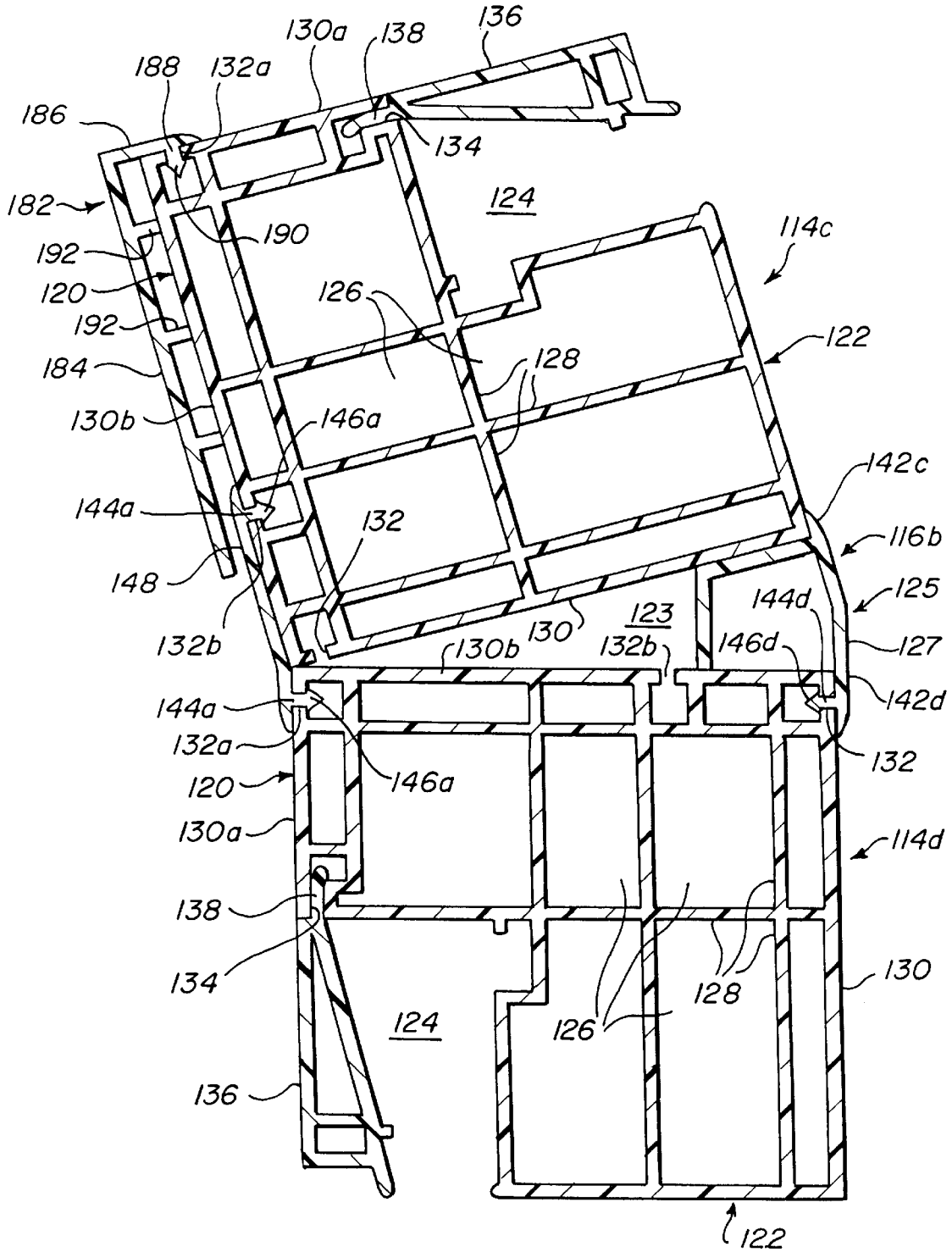
FIG. 7 is a cross-sectional view of the solarium of FIG. 5, taken along line 7—7 thereof.

FIG. 7 is a cross-section of FIG. 5, taken along line 7—7 thereof, and which shows a connection of front wall 106 and slanted roof 102. As shown therein, wall 130 of one frame member 114*c* of roof 102 faces a wall 130*b* of another frame member 114*d* of front wall 106 situated at an acute angle thereto, with both walls 130 and 130*b* being in contact at a front or outer corner thereof. Thus, the two frame members 114*c* and 114*d* are offset from each other to provide a substantially triangular space 123 for receiving a modified inner joint member 116*b*.

Specifically, modified joint member 116*b* includes, in cross-section, a substantially trapezoidal body 125, that is interposed between frame members 114*c* and 114*d* at the inner corners thereof, so as to maintain the aforementioned acute angle relationship. One end of the longer side 127 of trapezoidal body 125 includes an extension flange 142*c* that overlaps the free end surface of second leg 122 of frame member 114*c*. The opposite end of the longer side 127 of trapezoidal body 125 includes an extension flange 142*d* having one elongated protrusion or a plurality of protrusions 144*d* having free enlarged ends or arrow head tips 146*d* thereon that fit within holes or passages 132 of frame member 114*d*.

A second, bent outer joint member 148 is provided which spans the two adjacent frame members 114*c* and 114*d* of adjacent panels 110 and 112. Outer joint member 148 includes a series of protrusions 144*a* at opposite ends thereof, with each protrusion 144*a* including a free enlarged end or arrow head tip 146*a* extending therefrom. Protrusions 144*a* with their arrow head tips 146*a* interlock with holes or passages 132*b* in outer wall 130*b* of frame member 114*c* and with holes or passages 132*a* in outer wall 130*a* of frame member 114*d*, to provide for the assembly of panels 110 and 112 with connecting members 148.

In addition, a header cover 182 is provided in covering relation to outer wall 130*b* and part of upper wall 130*a* of frame member 114*c*. Header cover 182 includes an elongated plate 184 with an upper flange 186 at right angles thereto. Upper flange 186 includes one elongated protrusion or a plurality of protrusions 188 having free enlarged ends or arrow head tips 190 thereon, which fit within holes or passages 132*a* of frame member 114*c*. In addition, inwardly directed ribs 192 are provided on the inner surface of elongated plate 184 and serve to contact outer wall 130*b* of frame member 114*c*, so as to space elongated plate 184 therefrom. Elongated plate 184 extends down so as to be in covering relation to the upper portion of outer joint member 148. Header cover 182 serves to prevent rain and snow from entering upper holes or passages 132*a* of frame member 114*c*, and to also provide a cover to prevent rain and snow from entering between outer joint member 148 and outer wall 130*b* of frame member 114*c*. In effect, head cover 182 serves as a weather protector.

Figure 8:
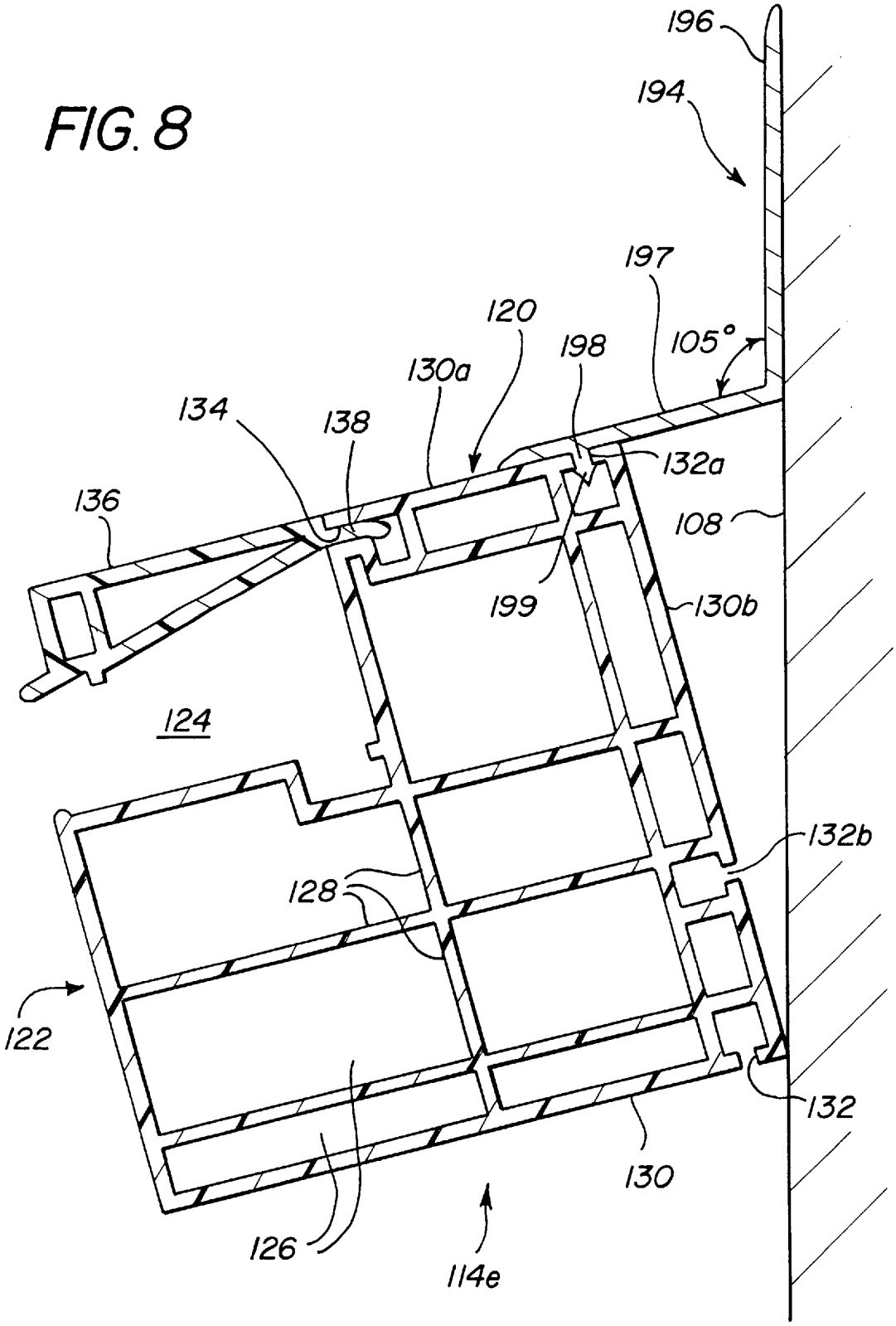
FIG. 8 is a cross-sectional view of the solarium of FIG. 5, taken along line 8—8 thereof.

FIG. 8 is a cross-section of FIG. 5, taken along line 8—8 thereof, and which shows a connection of slanted roof 102 to a wall 108 of a building. As shown, a wall securing plate 194 is bent at approximately 105° to form a first vertical leg 196 that is secured to wall 108 by screws, nails or the like, and a second bent leg 197 including a plurality of protrusions 198 having free enlarged ends or arrow head tips 199 thereon which fit within holes or passages 132*a* at the upper surface of a frame member 114*e* of slanted roof 102. Wall securing plate 194 is preferably made from aluminum or other metal material.

It will therefore be appreciated that frame members 114 of slanted roof 102 are supported at forward ends thereof by frame members 114 resting on frame members 114*d* of front wall 106 and secured thereto by joint members 148, and slanted roof 102 is supported at its rear end by frame members 114 secured to wall 108. In addition, as shown in FIG. 5, triangular shaped panels 111 are provided at the upper sides of side walls 104 of solarium 100 for further supporting the sides of slanted roof 102.

Figure 11:
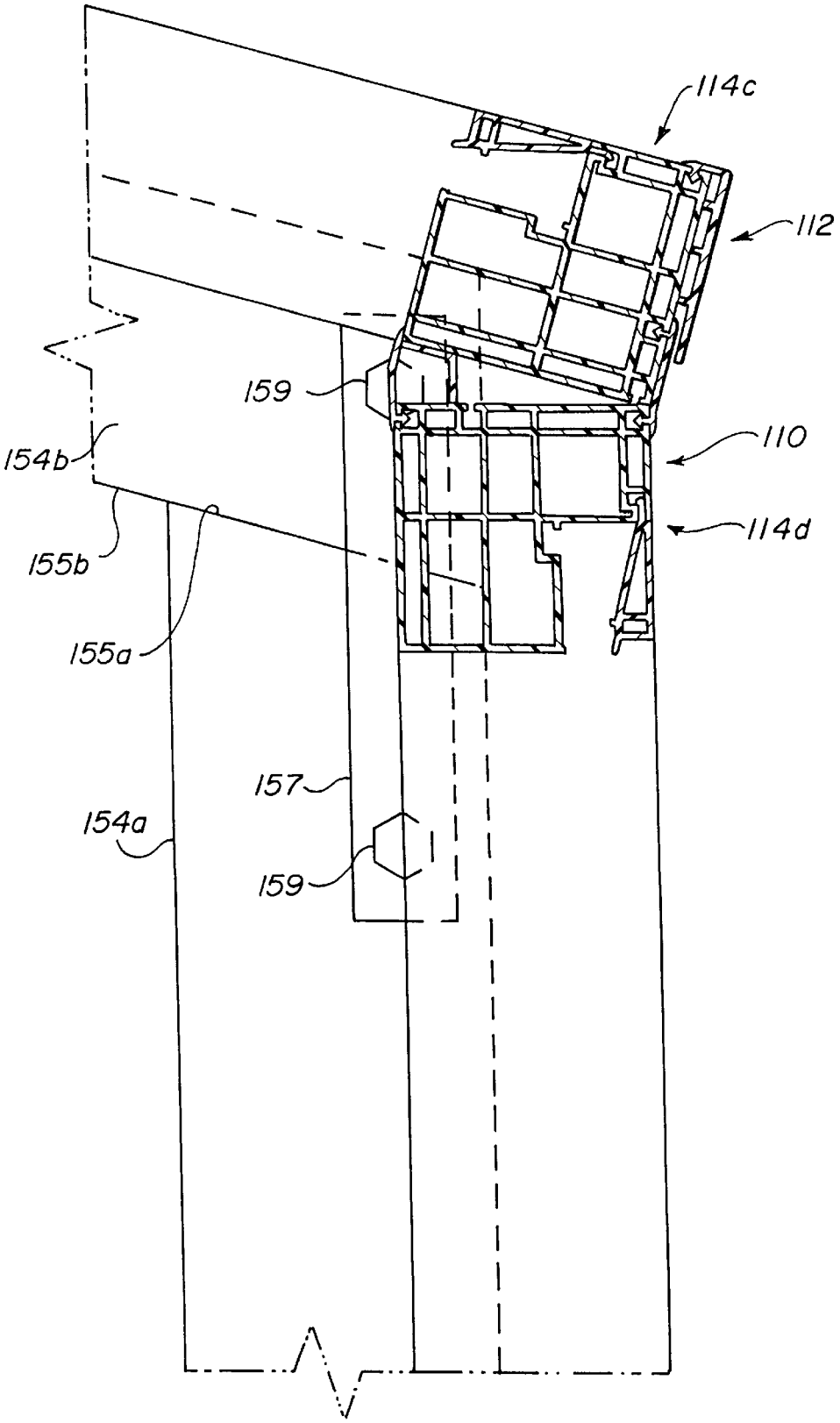
FIG. 11 a cross-sectional view showing a ceiling panel be supported on a wall panel by reinforcing plates.

However, it is preferred that the major support of slanted roof 102 occur by reason of reinforcing plates 154, as shown in FIG. 11. Specifically, as shown therein, a vertically oriented reinforcing plate 154*a* between wall panels 110 has a slanted upper edge 155*a* that extends rearwardly (toward the inside of the solarium) from wall panels 110, and a slanted reinforcing plate 154*b* between ceiling panels 112 has a slanted lower edge 155*b* that extends downwardly (toward the inside of the solarium) and that sits on slanted upper edge 155*a* of reinforcing plate 154*a*. The two reinforcing plates 154*a* and 154*b* are connected together by a connecting plate 157 via bolts 159.

Figures 9, 10:
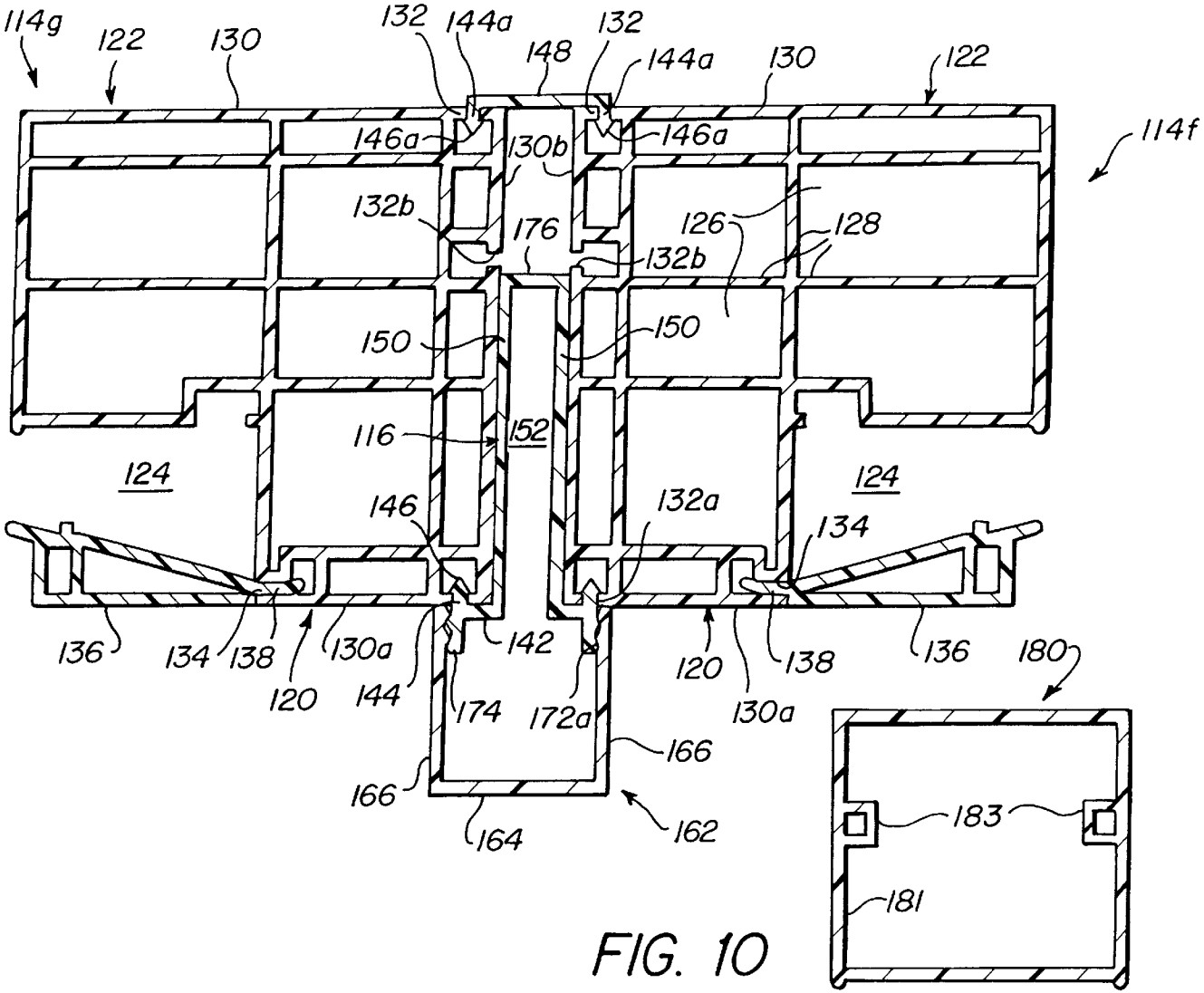
FIG. 9 is a cross-sectional view of the solarium of FIG. 5, taken along line 9—9 thereof.
FIG. 10 is a cross-sectional view of the one of the muntins of the ceiling panel.

Although reinforcing plates 154*a* and 154*b* are shown to extend inwardly of the solarium, which is in accordance with the embodiment of FIG. 1 of the present application, they could just as easily extend outwardly of the solarium in accordance with the embodiment of FIG. 9 of the present application. In such case, cover 162 would include two spaced apart flanges with inwardly gripping ribs as with elements 68 and 72 of FIG. 1, along with inwardly facing teeth on the inner surfaces of walls 150, as with elements 60 of FIG. 1.

FIG. 9 is a cross-section of FIG. 5, taken along line 9—9 thereof, and which shows a connection of the frames 114*f* and 114*g* of two adjacent panels 110 of a side wall 104.

FIG. 9 is essentially an assembled version of the frames 14 in FIG. 1, with the exception that the first and second joint members are reversed. Thus, second joint member 148 is positioned to the inside of frames 114*f* and 114*g*, while first joint member 116 is positioned to the outside of frames 114*f* and 114*g*. In addition, first joint member 116 includes two outwardly gripping latches 174 extending from flanges 142, with two inwardly gripping ribs 172*a* provided on the inner surfaces at the free ends of walls 166 of cover 162, which ribs 72*a* cooperate with the outwardly gripping latches 174 extending from flanges 142. Also, the spaced apart flanges on connecting member 164 are eliminated. In all other respects, the arrangement of FIG. 9 is the same as that shown in FIG. 1. Of course, it will be appreciated that the reverse could be arranged, as shown in FIG. 1, and that only one joint member need be used.

FIG. 10 is a cross-sectional view of one of the muntins 180 of ceiling panels 112, for supporting the glass therein. As shown, muntin 180 includes a generally rectangular frame 181 having inwardly directed screw housings 183 for securing muntin 180 to a frame 114 of a ceiling panel 112.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A modular solarium comprising:

(a) a plurality of prefabricated wall panels, each said prefabricated wall panel including:

(i) at least one transparent sheet of material having a peripheral edge, and (ii) a peripheral frame supporting said peripheral edge and positioned therearound, said peripheral frame having opposite exposed surfaces with an opening in at least one of said exposed surfaces;

(b) a plurality of prefabricated ceiling panels, each said prefabricated ceiling panel including:

(i) at least one transparent sheet of material having a peripheral edge, (ii) a peripheral frame supporting said peripheral edge and positioned therearound, said peripheral frame having opposite exposed surfaces with an opening in at least one of said exposed surfaces; and (c) a plurality of joint members for connecting together said prefabricated wall and ceiling panels, each said joint member including:

(i) a joint frame member, and (ii) at least two protrusions extending from said joint frame member, each said protrusion having a free enlarged end such that one protrusion lockingly engages within a respective said opening of a first one of said panels and another protrusion lockingly engages within a respective said opening of a second one of said panels, wherein said first and second panels are locked to each other by said joint members to form said modular solarium.

2. A modular solarium according to claim 1, wherein each said prefabricated wall and ceiling panel includes a retainer for retaining said at least one transparent sheet of material in a respective said peripheral frame.

3. A modular solarium according to claim 2, wherein the peripheral frame of each said prefabricated wall and ceiling panel includes at least one retainer opening for receiving at least one said retainer such that said at least one retainer clamps a respective said transparent sheet of material against the respective said peripheral frame.

4. A modular solarium according to claim 3, wherein each said retainer has a generally triangular cross-sectional configuration having at least one extension at an apex thereof, with said at least one extension fitting within said at least one retainer opening to secure said retainer to the respective said peripheral frame.

5. A modular solarium according to claim 3, wherein:

the peripheral frame of each said prefabricated wall and ceiling panel has an L-shaped cross-sectional configuration comprising a first leg and a second leg at right angles to said first leg, said second leg defining a seat on which said transparent panel is positioned, and said first leg having said at least one retainer opening therein for receiving said at least one retainer such that said at least one retainer clamps said respective transparent sheet of material against the second leg.

6. A modular solarium according to claim 1, wherein at least one said joint frame member has a generally U-shaped configuration, and includes two sets of said protrusions, said sets being arranged in spaced apart, substantially parallel relation and interconnected by said joint frame member.

7. A modular solarium according to claim 1, wherein at least one said joint frame member includes:

a central frame member, and two flanges extending away from each other at opposite sides of said central frame member, with said protrusions being formed on said flanges.

8. A modular solarium according to claim 7, wherein said central frame member has a U-shaped configuration which is positioned between adjacent panels to be connected together, said central frame member having opposite free ends, and said flanges extend from said opposite free ends of said U-shaped central frame member.

9. A modular solarium according to claim 8, wherein:

said central frame member includes two spaced apart walls which define a channel therebetween, and at least one said joint member includes a longitudinal reinforcement member captured within said channel.

10. A modular solarium according to claim 1, further including ceiling reinforcing members between adjacent ceiling panels and wall reinforcing members between adjacent wall panels, and said ceiling reinforcing members are supported by said wall reinforcing members so as to support said ceiling panels on said wall panels.

11. A modular solarium according to claim 1, wherein:

a first said joint frame member has a plurality of said protrusions which engage within at least one opening in an outer surface of each of peripheral frames of adjacent said prefabricated wall and ceiling panels, and a second joint frame member has a plurality of said protrusions which engage within at least one opening in an opposite inner surface of each of peripheral frames of said adjacent prefabricated wall and ceiling panels.

12. A modular solarium according to claim 11, further comprising an insulation member surrounded by said first and second joint frame members and the adjacent peripheral frames.

13. A modular solarium according to claim 1, wherein at least one said joint member further includes a cap which is secured to and covers the joint frame member thereof.

14. A modular solarium according to claim 1, wherein each of said peripheral frames includes a plurality of passages therein.

15. A modular solarium according to claim 1, wherein:

said solarium includes a corner between a front wall and a side wall thereof, two adjacent wall panels meet at said corner and are offset from each other so as to define a corner space, and at least one of said joint members is a corner joint member having a joint frame member positioned in said corner space and at least two said protrusions of said corner joint member extend from opposite first and second corners of said joint frame member such that at least one protrusion lockingly engages within a respective said opening of a first one of said adjacent wall panels and at least another protrusion lockingly engages within a respective said opening of a second one of said adjacent panels, wherein said first and second adjacent panels at said corner are locked to each other by said corner joint member.

16. A modular solarium according to claim 15, wherein:

said protrusions of said joint frame member of said corner joint member lockingly engage within respective openings in outer walls of said adjacent panels, said joint frame member of said corner joint member includes a third corner positioned at a junction of said first and second adjacent panels, said first one of said panels has an inner wall with a respective said opening therein, said second one of said panels has an inner wall with a respective said opening therein, and at least two further protrusions extend from said joint frame member at said third corner, each said further protrusion having a free enlarged end such that one further protrusion lockingly engages within the respective said opening in the inner wall of said first one of said panels and another protrusion lockingly engages within the respective said opening in the inner wall of said second one of said panels, wherein said first and second panels are further locked to each other by said corner joint member.

17. A modular solarium according to claim 1, wherein said wall panels define a front wall, and said ceiling panels are inclined upwardly and rearwardly from said wall panels of the front wall of said modular solarium.

18. A modular solarium according to claim 17, wherein at least one said protrusion of said joint frame member lockingly engages within a respective said opening in an outer wall of one said ceiling panel and at least another said protrusion lockingly engages within a respective said opening in an outer wall of an adjacent said wall panel of said front wall, wherein said ceiling and wall panels are locked to each other by said joint member; and further including a wedge joint member mounted at an upper surface of said wall panel adjacent an inner surface thereof, for supporting said adjacent ceiling panel thereon at an inclination.

19. A modular solarium according to claim 18, wherein at least one of said ceiling panel and adjacent wall panel has an inner surface with a respective said opening therein, and said wedge joint member includes a substantially trapezoidal joint frame member having at least one protrusion with a free enlarged end such that said at least one protrusion lockingly engages within the respective said opening in the inner surface of at least one of said ceiling panel and adjacent wall panel.

20. A modular solarium according to claim 17, wherein each said ceiling panel includes a rear portion with a respective said opening therein, and further comprising a wall securing member adapted to be secured to a wall of a building and including at least one protrusion having a free enlarged end for lockingly engaging within the respective said opening at the rear portion of each said ceiling panel.

21. A kit for forming a modular solarium construction, comprising:

(a) a plurality of prefabricated wall panels, each said prefabricated wall panel including:

(i) at least one transparent sheet of material having a peripheral edge, (ii) a peripheral frame supporting said peripheral edge and positioned therearound, said peripheral frame having opposite exposed surfaces with an opening in at least one of said exposed surfaces;

(b) a plurality of prefabricated ceiling panels, each said prefabricated ceiling panel including:

(i) at least one transparent sheet of material having a peripheral edge, (ii) a peripheral frame supporting said peripheral edge and positioned therearound, said peripheral frame having opposite exposed surfaces with an opening in at least one of said exposed surfaces; and (c) a plurality of joint members for connecting together said prefabricated panels, each said joint member including:

(i) a joint frame member, and (ii) at least two protrusions extending from said joint frame member, each said protrusion having a free enlarged end such that one protrusion is adapted to lockingly engage within a respective said opening of a first one of said panels and another protrusion is adapted to lockingly engage within a respective said opening of a second one of said panels, wherein said first and second panels are adapted to be locked to each other by said joint members to form said modular solarium.

22. A kit for forming a modular solarium construction according to claim 21, wherein each said prefabricated panel includes a retainer for retaining said at least one transparent sheet of material in a respective said peripheral frame.

23. A kit for forming a modular solarium construction according to claim 22, wherein each said peripheral frame includes at least one retainer opening for receiving at least one said retainer such that said at least one retainer clamps a respective said transparent sheet of material against the respective said peripheral frame.

24. A kit for forming a modular solarium construction according to claim 23, wherein each said retainer has a generally triangular cross-sectional configuration having at least one extension at an apex thereof, with said at least one extension fitting within said at least one retainer opening to secure said retainer to the respective said peripheral frame.

25. A kit for forming a modular solarium construction according to claim 24, wherein:

each said peripheral frame has an L-shaped cross-sectional configuration comprising a first leg and a second leg at right angles to said first leg, said second leg defining a seat on which said transparent panel is positioned, and said first leg having said at least one retainer opening therein for receiving said at least one retainer such that said at least one retainer clamps said respective transparent sheet of material against the second leg.

26. A kit for forming a modular solarium construction according to claim 21, wherein at least one said joint member has a generally U-shaped configuration, and includes two sets of said protrusions, said sets being arranged in spaced apart, substantially parallel relation and interconnected by said joint frame member.

27. A kit for forming a modular solarium construction according to claim 21, wherein at least one said joint frame member includes:

a central frame member, and two flanges extending away from each other at opposite sides of said central frame member, with said protrusions being formed on said flanges.

28. A kit for forming a modular solarium construction according to claim 27, wherein said central frame member has a U-shaped configuration which is adapted to be positioned between adjacent panels to be connected together, said central frame member having opposite free ends, and said flanges extend from said opposite free ends of said U-shaped central frame member.

29. A kit for forming a modular solarium construction according to claim 28, wherein:

said central frame member includes two spaced apart walls which define a channel therebetween, and at least one said joint member includes a longitudinal reinforcement member adapted to be captured within said channel.

30. A kit for forming a modular solarium construction according to claim 21, wherein:

a first said joint frame member has a plurality of said protrusions which are adapted to engage within at least one opening in an outer surface of each of peripheral frames of adjacent said prefabricated wall panels, and a second joint frame member has a plurality of said protrusions which are adapted to engage within at least one opening in an opposite inner surface of each of peripheral frames of said adjacent prefabricated wall panels.

31. A kit for forming a modular solarium construction according to claim 30, further comprising an insulation member adapted to be surrounded by said first and second joint frame members and the adjacent peripheral frames.

32. A kit for forming a modular solarium construction according to claim 21, wherein at least one said joint member further includes a cap which is secured to and covers the joint frame member thereof.

33. A kit for forming a modular solarium construction according to claim 21, wherein each of said peripheral frames includes a plurality of cavities therein.

34. A kit for forming a modular solarium construction according to claim 21, wherein:

said solarium, when constructed, includes a corner between a front wall and a side wall thereof, two adjacent wall panels are constructed to meet at said corner so as to be offset from each other and thereby define a corner space, and at least one of said joint members is a corner joint member having a joint frame member adapted to be positioned in said corner space and at least two said protrusions of said corner joint member extend from opposite first and second corners of said joint frame member such that at least one protrusion is adapted to lockingly engage within a respective said opening of a first one of said adjacent wall panels and at least another protrusion is adapted to lockingly engage within a respective said opening of a second one of said adjacent panels, for locking said first and second adjacent panels at said corner to each other by said corner joint member.

35. A kit for forming a modular solarium construction according to claim 34, wherein:

said protrusions of said joint frame member of said corner joint member are adapted to lockingly engage within respective openings in outer walls of said adjacent panels, and said joint frame member of said corner joint member includes a third corner positioned at a junction of said first and second adjacent panels, said first one of said panels has an inner wall with a respective said opening therein, said second one of said panels has an inner wall with a respective said opening therein, and at least two further protrusions extend from said joint frame member at said third corner, each said further protrusion having a free enlarged end such that one further protrusion is adapted to lockingly engage within the respective said opening in the inner wall of said first one of said panels and another protrusion is adapted to lockingly engage within the respective said opening in the inner wall of said second one of said panels, for further locking said first and second panels to each other by said corner joint member.

36. A kit for forming a modular solarium construction according to claim 35, wherein:

said wall panels define a front wall, said ceiling panels, when assembled, are inclined upwardly and rearwardly from said wall panels of the front wall of said modular solarium, and at least one said protrusion of said joint frame member is adapted to lockingly engage within a respective said opening in an outer wall of one said ceiling panel and at least another said protrusion is adapted to lockingly engage within a respective said opening in an outer wall of an adjacent said wall panel of said front wall, for locking said ceiling and wall panels to each other by said joint member; and further including a wedge joint member mounted at an upper surface of said wall panel adjacent an inner surface thereof, for supporting said adjacent ceiling panel thereon.

37. A kit for forming a modular solarium construction according to claim 36, wherein at least one of said ceiling panel and adjacent wall panel has an inner surface with a respective said opening therein, and said wedge joint member includes a substantially trapezoidal joint frame member having at least one protrusion with a free enlarged end such that at said least one protrusion is adapted to lockingly engage within a respective said opening in the inner surface of at least one of said ceiling panel and adjacent wall panel.

38. A kit for forming a modular solarium construction according to claim 35, wherein each said ceiling panel includes a rear portion with a respective said opening therein, and further comprising a wall securing member adapted to be secured to a wall of a building and including at least one protrusion having a free enlarged end for lockingly engaging within the respective said opening at the rear end of each said ceiling panel.

39. A modular solarium according to claim 21, further including ceiling reinforcing members for engagement between adjacent ceiling panels and wall reinforcing members for engagement between adjacent wall panels, such that said ceiling reinforcing members are adapted to be supported by said wall reinforcing members for supporting said ceiling panels on said wall panels.

* * * * *